US008803775B2

(12) United States Patent
Yang et al.

(10) Patent No.: US 8,803,775 B2
(45) Date of Patent: Aug. 12, 2014

(54) MOTION IMAGE DATA SEQUENCE, A METHOD FOR GENERATING THE SEQUENCE, AND A DISPLAY APPARATUS USING THE SEQUENCE

(75) Inventors: Chang-Ling Yang, Tainan County (TW); Shen-De Yu, Gueishan Township, Taoyuan County (TW)

(73) Assignee: Qisda Corporation, Taoyuan County (TW)

( * ) Notice: Subject to any disclaimer, the term of this patent is extended or adjusted under 35 U.S.C. 154(b) by 1706 days.

(21) Appl. No.: 12/007,384

(22) Filed: Jan. 9, 2008

(65) Prior Publication Data

US 2008/0165107 A1 Jul. 10, 2008

(30) Foreign Application Priority Data

Jan. 10, 2007 (TW) ..... 96100949 A

(51) Int. Cl.
*G09G 3/36* (2006.01)

(52) U.S. Cl.
USPC ..... 345/87; 345/88

(58) Field of Classification Search
USPC ..... 345/87–104
See application file for complete search history.

(56) References Cited

U.S. PATENT DOCUMENTS

| | | | | |
|---|---|---|---|---|
| 6,072,451 | A * | 6/2000 | Mano et al. | 345/89 |
| 6,661,425 | B1 * | 12/2003 | Hiroaki | 345/629 |
| 6,771,243 | B2 | 8/2004 | Hirohata | |
| 7,940,240 | B2 * | 5/2011 | Takeuchi et al. | 345/94 |
| 2003/0169247 | A1 * | 9/2003 | Kawabe et al. | 345/204 |
| 2005/0104834 | A1 * | 5/2005 | Tsuchihashi | 345/96 |
| 2006/0022933 | A1 * | 2/2006 | Endo et al. | 345/98 |
| 2006/0082530 | A1 * | 4/2006 | Chen et al. | 345/87 |
| 2006/0092164 | A1 * | 5/2006 | Takeuchi et al. | 345/530 |
| 2007/0085794 | A1 * | 4/2007 | Kawabe et al. | 345/89 |
| 2007/0120793 | A1 * | 5/2007 | Kimura | 345/89 |
| 2007/0146279 | A1 * | 6/2007 | Oke et al. | 345/94 |
| 2008/0252586 | A1 * | 10/2008 | Cheng | 345/99 |

* cited by examiner

*Primary Examiner* — Alexander Eisen
*Assistant Examiner* — Nelson Lam

(57) ABSTRACT

A motion image data sequence, a method for generating the sequence, and a display device using the sequence are provided. The display device includes an image data input device and an image data processor. The image data input device transmits an initial image data to the image data processor. The image data processor inserts a mask frame between a first timing image frame and a third timing image frame to generate an output image data sequence. The mask frame includes a plurality of mask units and a plurality of image units. The mask units and the image units are disposed in an array form.

25 Claims, 22 Drawing Sheets

MOTION IMAGE DATA SEQUENCE, A METHOD FOR GENERATING THE SEQUENCE, AND A DISPLAY APPARATUS USING THE SEQUENCE

BACKGROUND OF THE INVENTION

1. Field of the Invention

The present invention relates to an image data sequence, a method for generating the sequence, and a display apparatus using the sequence; specifically, the present invention is related to a motion image data sequence, a method for generating the motion image data sequence, and a display apparatus using the sequence.

2. Description of the Prior Art

With recent technology advance, applications of various types of image displays become more and more popular. As image output interface, displays can be seen everywhere, such as traditional televisions, computer monitors, and surveillance devices. In addition, from traditional cathode ray tube (CRT) to broadly used liquid crystal display (LCD), plasma display, and light emitting diode (LED) display in development, types of displays updates continuously. Continuous research and development is aiming at high resolution and thin type in display technology field.

Traditional cathode ray tube (CRT) display has spread phosphor atoms on the screen and excites phosphor atoms by an electronic gun scanning to release red, blue and green lights and generate images. Since there is a time interval between two scans at the same point on the screen, motion images which the CRT display generates are displayed in pulse forms. In other words, images of CRT displays actually flash very rapidly. However, due to limit of human eyesight, human eyes cannot observe the flashes from image pulses; therefore, images displayed in pulse forms have better visual effects to human eyes.

However, for traditional liquid crystal display (LCD), images are not displayed by scanning, instead, image frames at each time point are displayed continuously without interruption, so as to form a motion visual effect. However, for human eyesight, this kind of continuous display normally causes vision persistence which makes human eyes retaining motion images at the previous time point when seeing motion images at the time point next to the previous time point.

To overcome this problem, conventionally, a mask frame 15 is inserted between two consecutive image frames 10, as shown in FIG. 1*a*. The inserted mask frame 15 generates an interrupting visual effect that reduces the vision persistence. As shown in FIG. 1*b*, as display brightness is close to zero when a traditional black mask frame 15 inserts, the performance of motion image brightness worsens.

As shown in FIG. 1*c* and FIG. 1*d*, a traditional mask frame 15 is formed by overlapping parallel black lines or single black block on the previous image frame 10. A better brightness may be preserved with these kinds of mask frame 15. However, while movements of an image object 24 are usually multi-directional, these kinds of mask frame 15 can only reduce the vision persistence of image object 24 in a single direction. When the image object 24 moves in another direction, the vision persistence of image object 24 still exists. For instance, in the example shown in FIG. 1*e*, when the image object 24 moves in y-axis direction, the mask frame 15 cannot generate an interrupting visual effect.

SUMMARY OF THE INVENTION

An objective of present invention is to provide an image data sequence, to reduce the vision persistence when displaying motion images.

An objective of present invention is to provide an image data sequence, to reduce the loss of brightness caused by inserting mask frames.

An objective of present invention is to provide an image data sequence, being able to reduce the effect of vision persistence in multiple directions.

An objective of present invention is to provide an image display device, having a better motion visual effect.

Image display device in the present invention includes an image data input device, an image data processor, and a display device. Image data input device transmits an initial image data from outside signal source to the image data processor. Image data processor transforms the initial image data to an image data sequence, and transmits the image data sequence to the display device as an image output.

Initial image data includes a plurality of image frames. Image frames includes a first timing image frame, a third timing image frame, a fifth timing image frame, and other image frames in time sequence. Image data processing device inserts a mask frame between the first timing image frame and the third timing image frame to generate a image data sequence output.

A mask frame includes a plurality of mask units and a plurality of image units. Mask units and display units are arranged in an array form; in other words, mask units and display units are arranged in two intersecting array directions. Mask units and image units arranging in different directions in the array results in a multi-directional mask effect for the mask frames, thereby reduces differences of mask effect in different directions. In addition, the way of arranging mask units and image units in array form can reduce impact of mask frame on brightness of output images.

In a preferred embodiment, the image data sequence output further includes a complementary mask frame. The complementary mask frame is optionally sequenced between the mask frame and the third timing image frame, or after the third timing image frame. The complementary mask frame includes a plurality of complementary mask units and a plurality of complementary image units, the positions of complementary mask units and those of complementary image units are respectively opposite to positions of mask units and those of image units. Since mask units in the mask frame changes an area from bright to dark, mask units influence performance of brightness at its position and the brightness in the whole area. Complementary mask frame can reduce the influence on the brightness in the whole area.

Method for generating an image data sequence of the present invention preferably comprises obtaining an initial image data and inserting a mask frame sequenced between the first timing image frame and the third timing image frame of the initial image data. The step of inserting mask frame further comprises duplicating the first timing image frame to generate a duplicated first timing image frame, and, setting a data address value corresponding to the mask unit in the duplicated first timing image frame as a first value, by using AND operation.

In a preferred embodiment, the step of inserting mask frame further comprises comparing the first timing image frame and the third timing image frame to decide a image moving speed, and, deciding mask frame size based on the image moving speed. In addition to image moving speed, mask frame size can be adjusted based on the image frame refresh rate.

DETAILED DESCRIPTION OF THE PREFERRED EMBODIMENT

An image data sequence and the image display device using the image data sequence is provided in the present invention. In addition, present invention further includes a method for generating image data sequence. Image data sequence described herein exists in various types of image data signals, for example, digital signals or analog signals; image data sequence also includes various types of image compression formats, such as MPEG4, DivX, Indeo, etc. Besides, image display device preferably includes display devices using consecutive signals to display images, such as LCD display devices and OLED display devices.

Figure 1A:
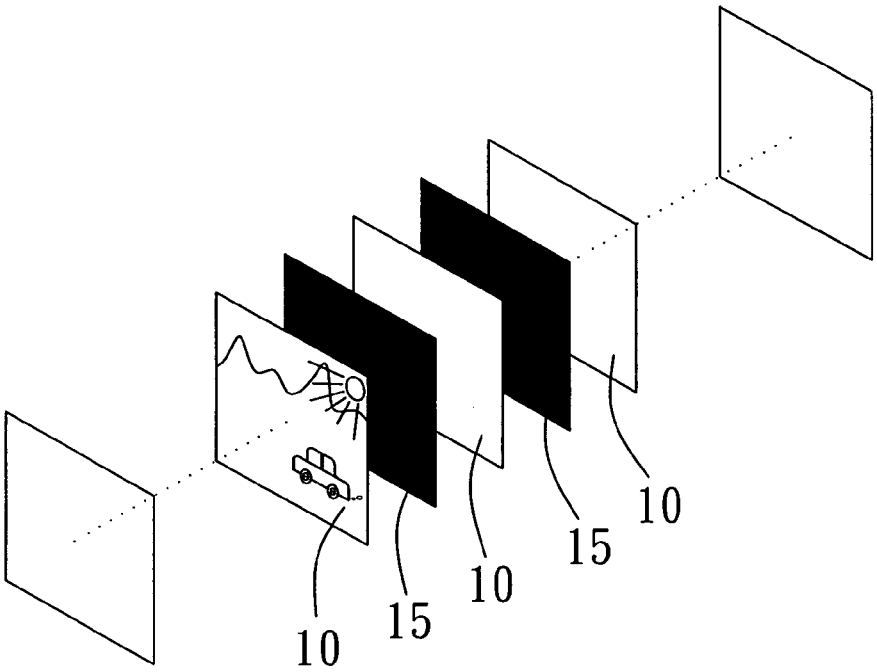
Fig. 1a (PRIOR ART)
FIG. 1*a* illustrates a traditional arrangement of image frame and mask frame.
Figure 1B:
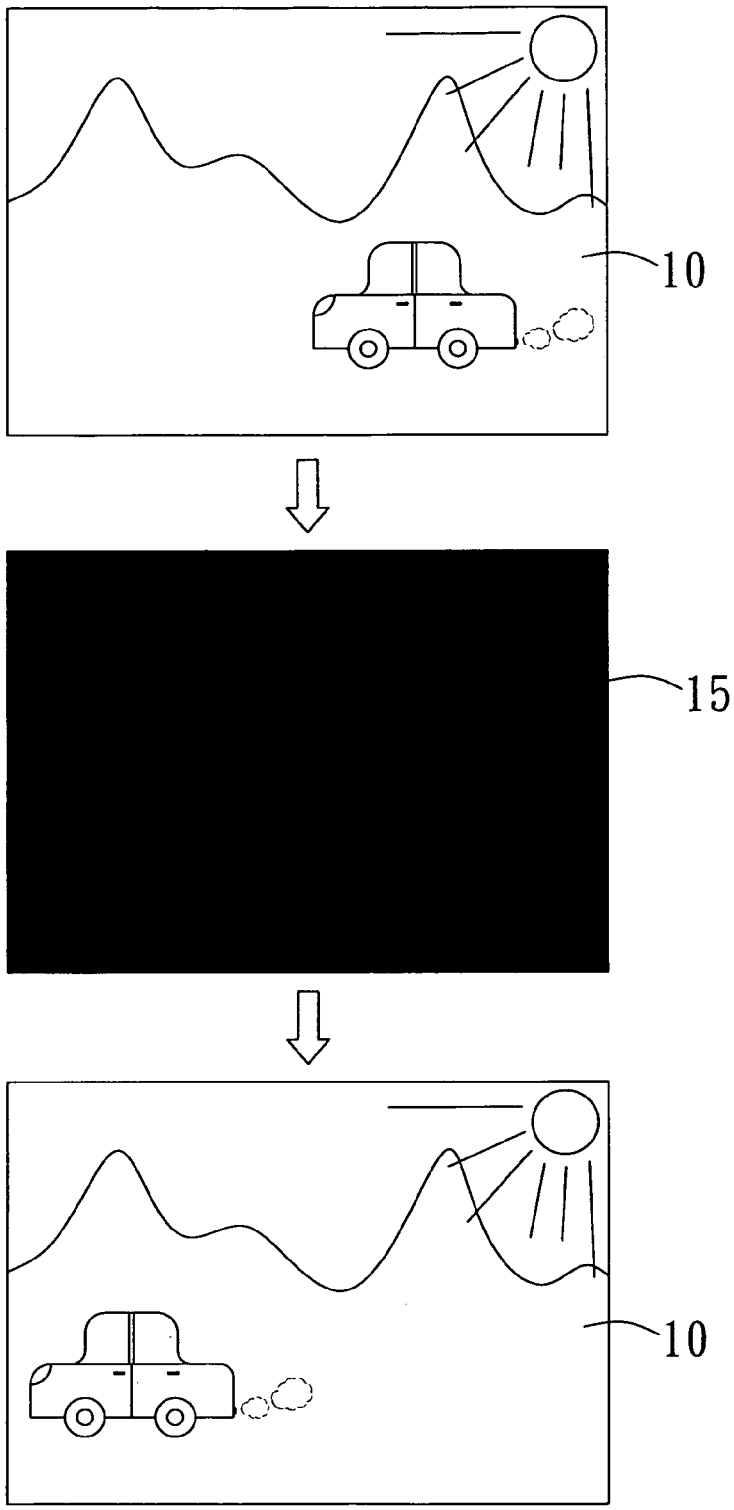
Fig. 1b (PRIOR ART)
FIG. 1*b* illustrates a traditional mask frame.
Figure 1C:
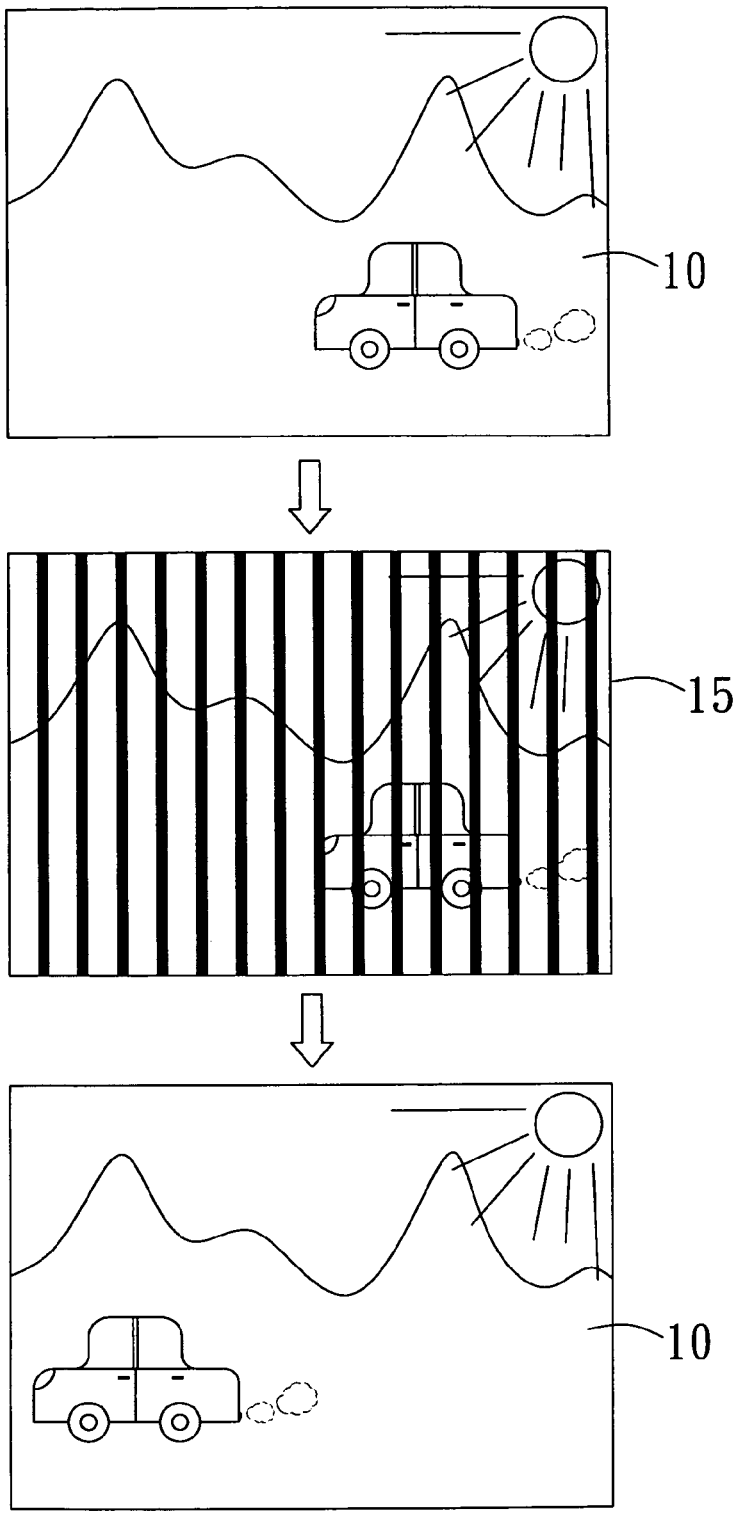
Fig. 1c (PRIOR ART)
FIG. 1*c* illustrates another traditional mask frame.
Figure 1D:
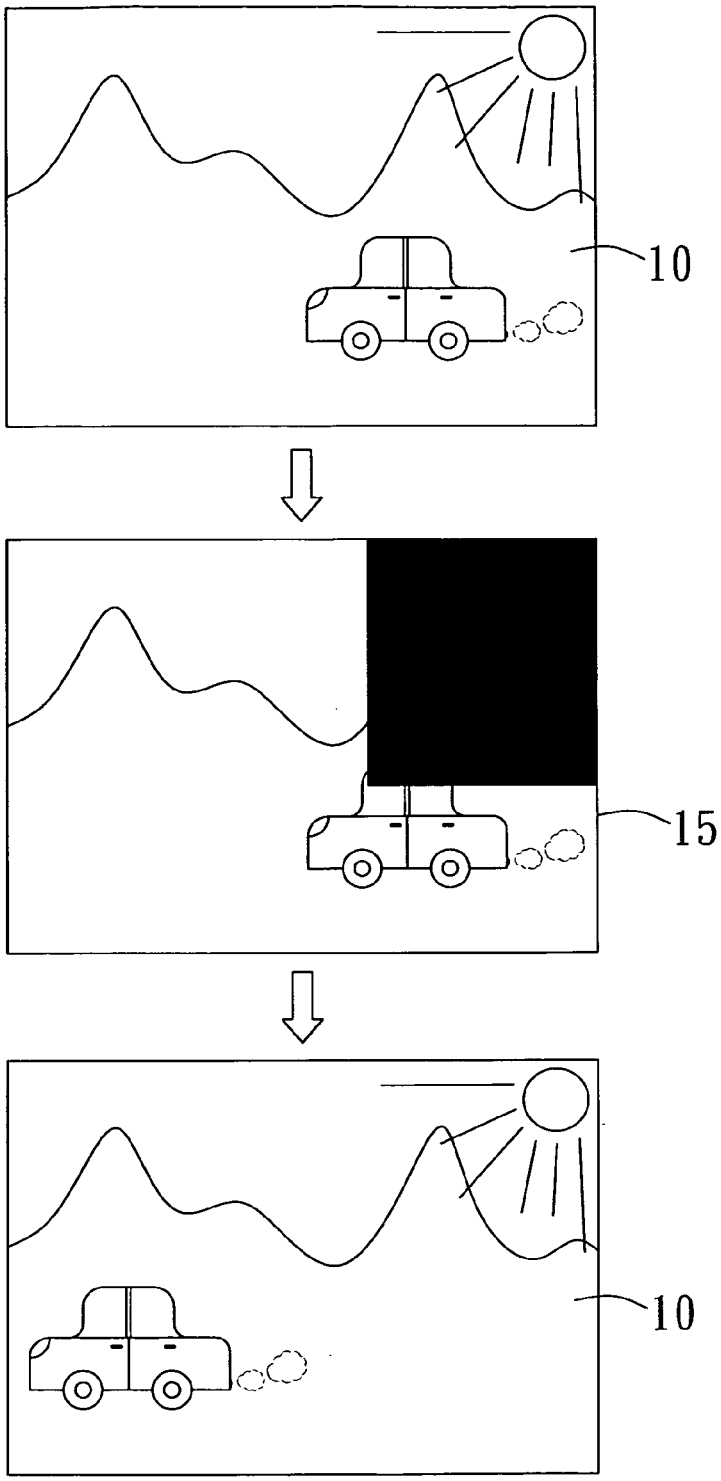
Fig. 1d (PRIOR ART)
FIG. 1*d* illustrates another traditional mask frame.
Figure 1E:
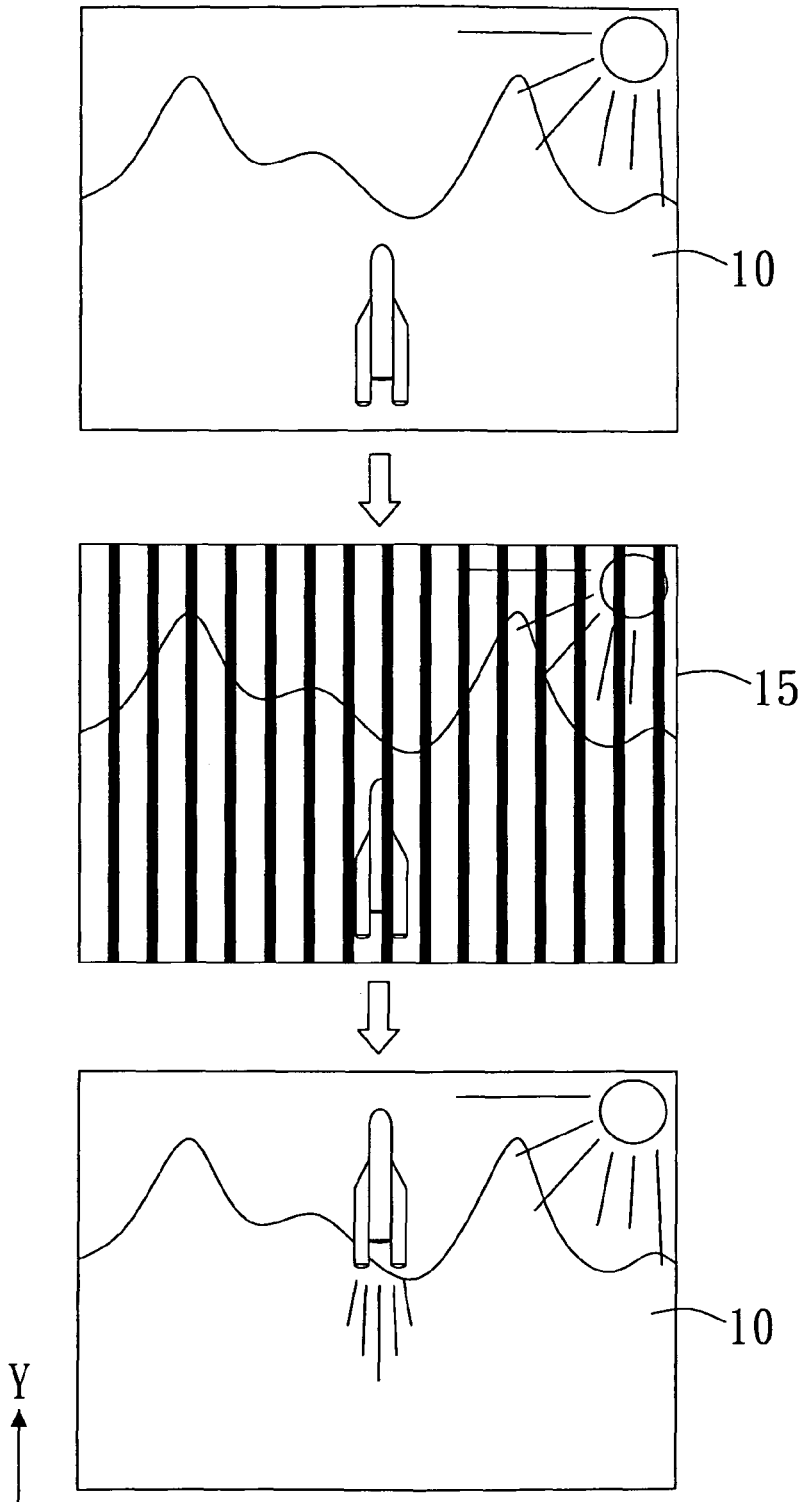
Fig. 1e (PRIOR ART)
FIG. 1*e* illustrates another traditional mask frame.
Figure 2:
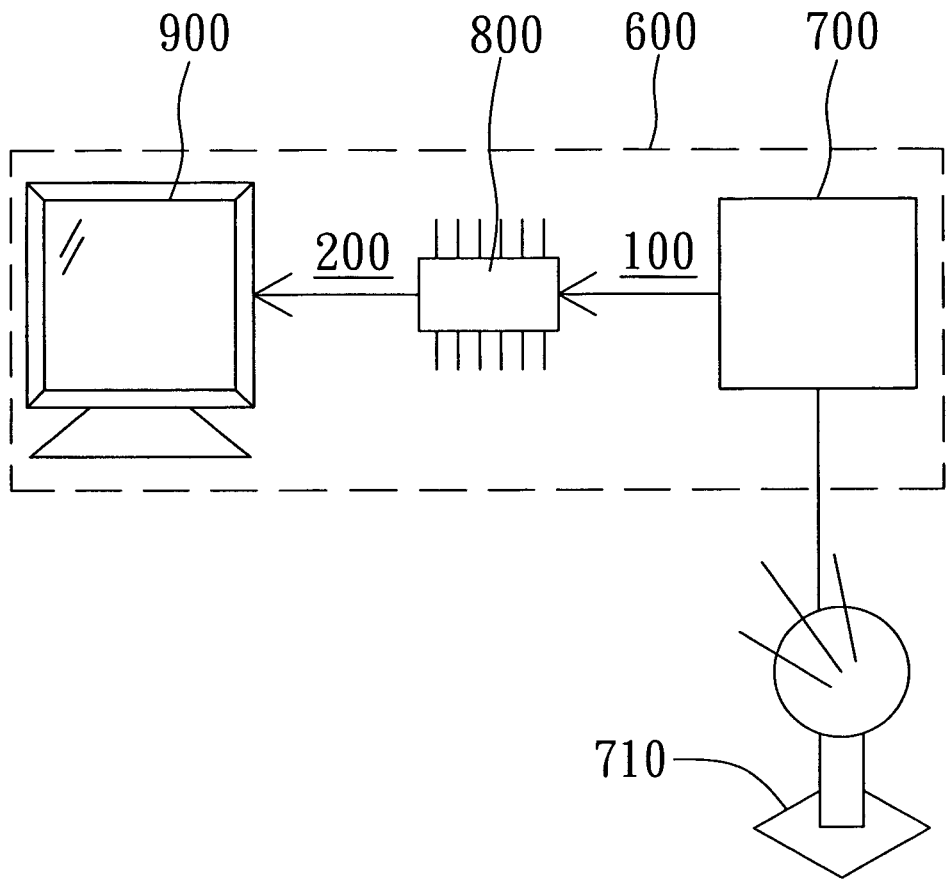
FIG. 2 illustrates one embodiment of an image display device in the present invention.

As shown in FIG. 2, image display device 600 in the present invention includes an image data input device 700, an image data processor 800, and a display device 900. In the preferred embodiment, image data input device 700 includes analog signal receiving ports; however, in other embodiments, image data input device 700 also includes digital signal receiving ports. In addition, image data input device 700 includes various types of compatible interfaces for outside signal source 710, such as cable signal connector, D-sub connector, HDMI connector, AV connector, S connector, etc. Image data processor 800 preferably includes image graphic cards or display device processors, etc. Display device 900 preferably includes LCD panels or OLED panels.

Figure 3:
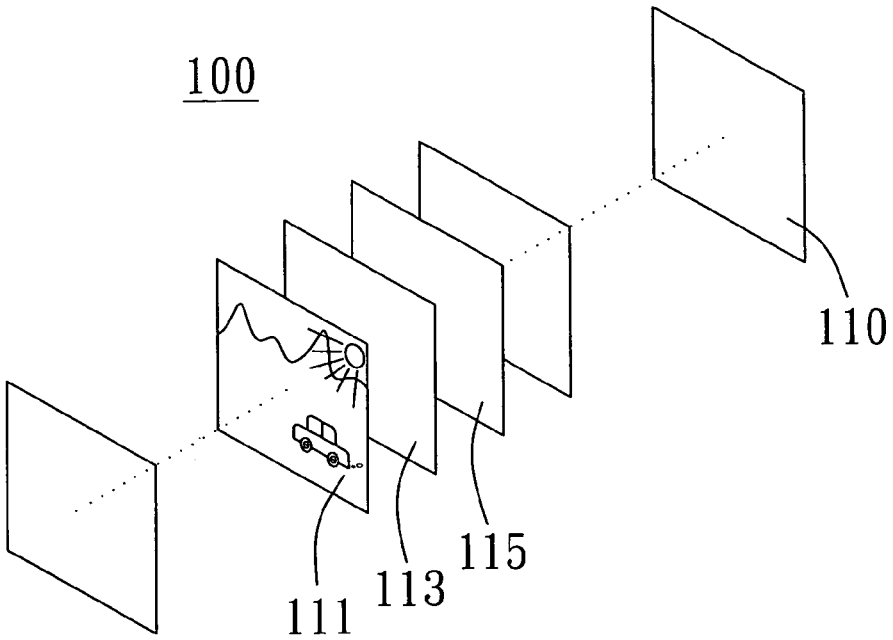
FIG. 3 illustrates one embodiment of an initial image data.

As shown in FIG. 3, initial image data 100 includes a plurality of image frames 110. Image frames 110 include a first timing image frame 111, a third timing image frame 113, a fifth timing image frame 115, and other image frames in time sequence. In one preferred embodiment, every image frame includes image data of each image position corresponding to every time point. Image data described herein includes display color, brightness, other parameters or electrical signals transformed from those parameters. Initial image data 100 exists in analog signals or in digital signals, dependent on the signal type provided by outside signal source 710. Besides, initial image data 100 is compatible to various types of compression formats or protocols, such as MPEG2 or MPEG4.

As shown in FIG. 2, image data input device 700 transmits the initial image data 100 to the image data processor 800. Image data processor 800 transforms the initial image data 100 to output image data sequence 200 and transmits the output image data sequence 200 to the display device 900 to be an output image. According to the preferred embodiment, output image data sequence 200 exists in digital signals. Please refer to FIG. 4, output image data sequence 200 includes a first timing image frame 211, a third timing image frame 213, a fifth timing image frame 215, and other image frames in time sequence. First timing image frame 211, third timing image frame 213, and fifth timing image frame 215 continue to use contents of the image frames of the corresponding time points in the initial image data 100. In preferred embodiment, image frame at every time point described above includes image data of each image position displayed on the display device 900 at corresponding time point. Image data described herein includes display color, brightness, other parameters or electrical signals transformed from those parameters.

Figure 4:
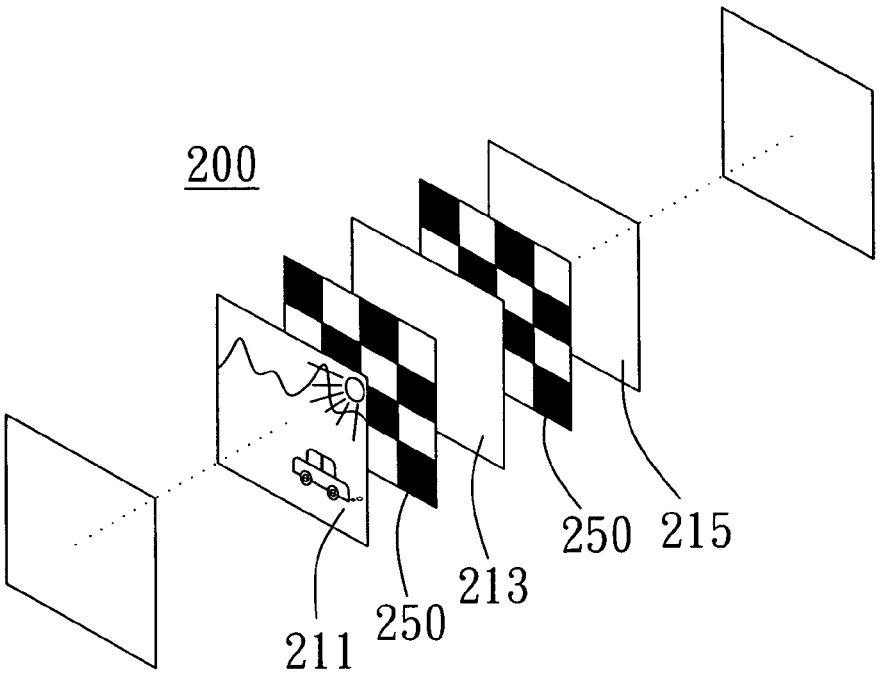
FIG. 4 illustrates one embodiment of an image data sequence output.
Figure 5A:
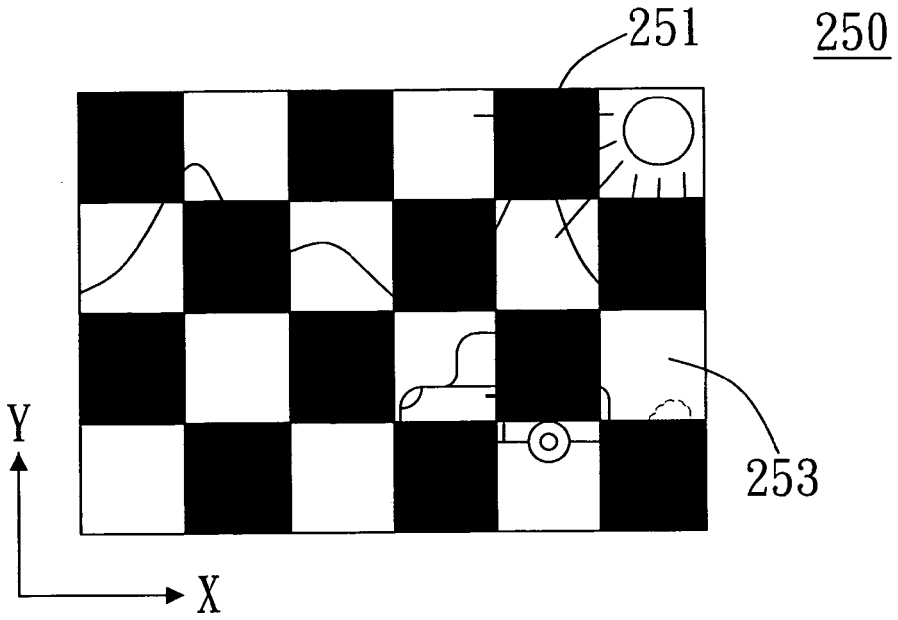
FIG. 5*a* illustrates one embodiment of mask frame.
Figure 5B:
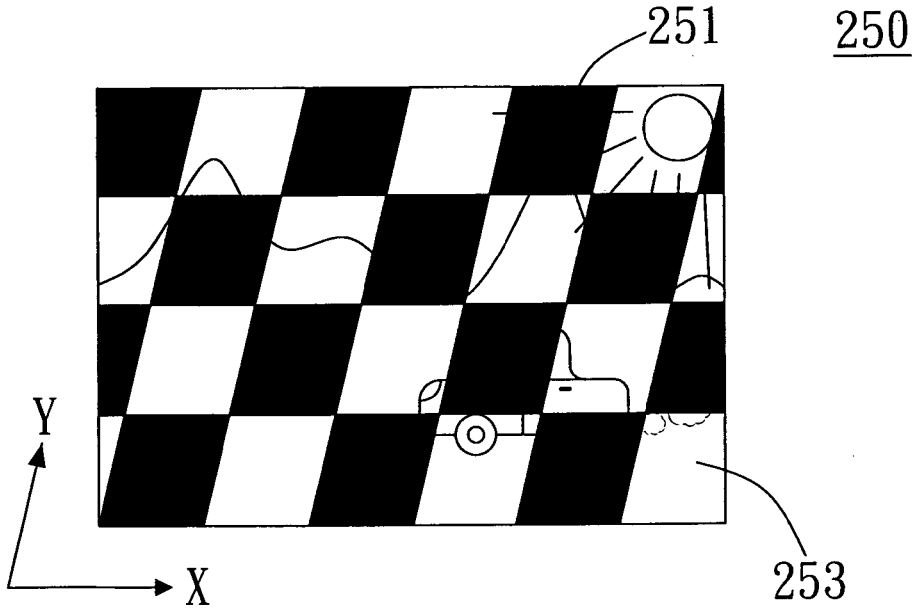
FIG. 5*b* illustrates another embodiment of mask frame.

As shown in FIG. 4, output image data sequence 200 further includes a mask frame 250. In this embodiment, image data processor 800 inserts mask frame 250 between first timing image frame 211 and third timing image frame 213, and between third timing image frame 213 and fifth timing image frame 215. As shown in FIG. 5, mask frame 250 includes a plurality of mask units 251 and a plurality of image units 253 arranged in array form; in other words, mask units 251 and display units 253 are arranged in two intersecting array directions X and Y. Array direction X and array direction Y are preferably perpendicular, as shown in FIG. 5*a*. However, in other embodiments, as shown in FIG. 5*b*, array directions X and Y can form an included angle other than 90 degrees. In addition, in the same array direction, a image unit 253 is inserted between every two mask units 251. Mask units 251 and image units 253 arranged in different directions in the array results in a multi-directional mask effect for the mask frame 250, thereby reduces differences of mask effects in different directions. In addition, arranging mask units 251 and image units 253 in array form can reduce impact of mask frame 250 on brightness of output images as a whole.

Figure 6:
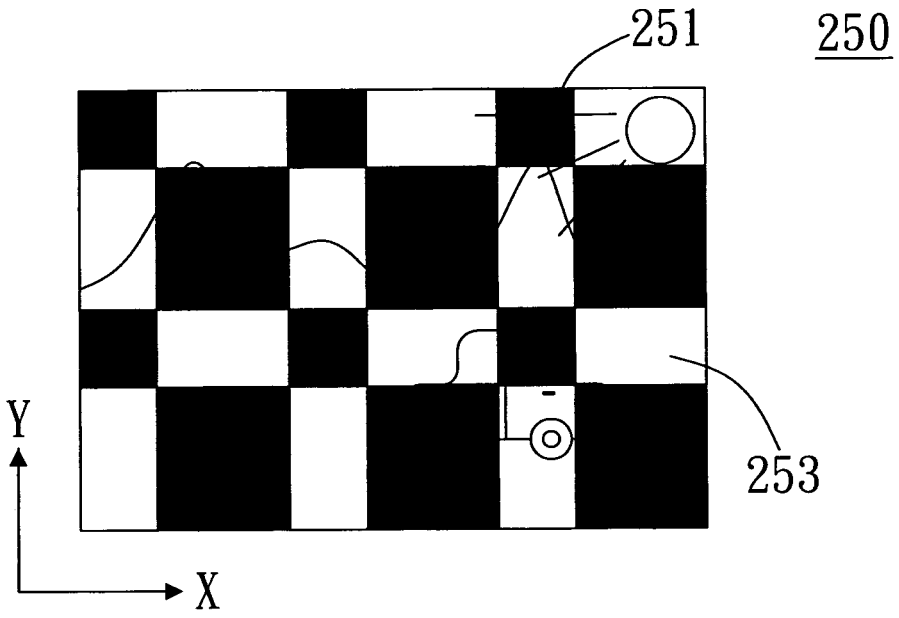
FIG. 6 illustrates one embodiment of mask units and display units in different rows and columns having different area sizes.

In the embodiment shown in FIG. 5*a*, mask units 251 form rectangular dark areas on the mask frame 250, and image units 253 form rectangular image areas on the mask frame 250. As shown in FIG. 5*a*, a side of the rectangular dark area is adjacent to a side of the rectangular image area; in other words, every mask unit 251 and every image unit 253 have substantially the same area size to form a check-like pattern on the mask frame 250. However in other embodiments, area size and pattern of every mask unit 251 and image unit 253 are not necessarily the same. For example, in FIG. 6, mask units 251 and image units 253 in different rows and columns have different area sizes, while summation of all the mask units 251 areas equals summation of all the image units 253 areas. In addition, in other embodiments, patterns, sizes, positions, and other designs of mask units 251 and image units 253 can be changed according to different image characteristics, for example, designs of motion image mask units are different from those of static image mask units.

Figure 7A:
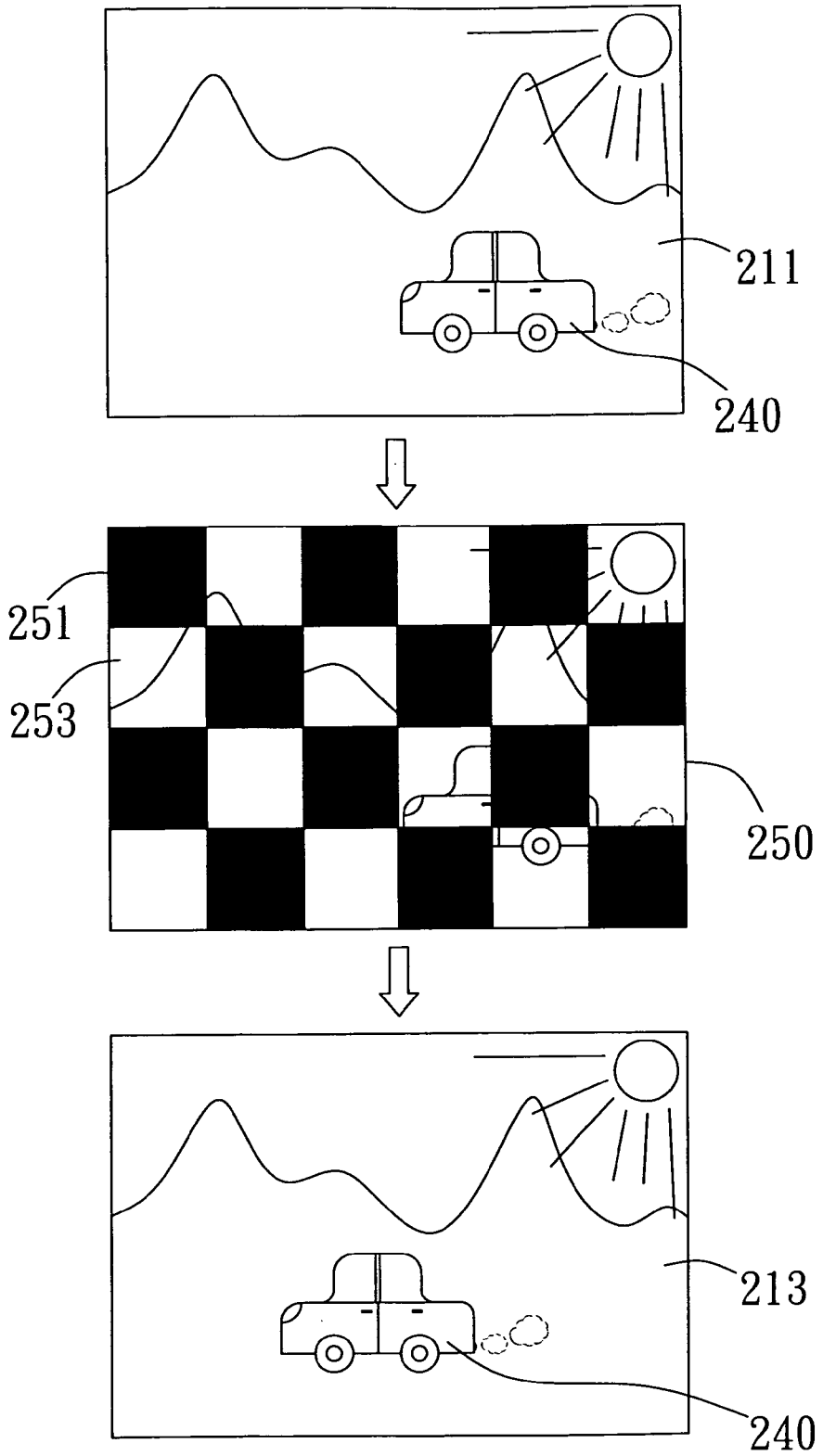
FIG. 7*a* illustrates a comparison of an object moving speed in different image frames.

Side length of the mask unit 251 is preferably between one pixel to eight pixels, however dependent on different image characteristics, side length of the mask unit 251 can be adjusted. As shown in FIG. 7*a*, since the third timing image frame 213 shows up after the first timing image frame 211, an image object 240 on the third timing image frame 213 has an object moving speed relative to the image object 240 on the first timing image frame 211. Image object 240 described herein is preferably a foreground motion image object; however in other embodiments, image object 240 can include background image object. Object moving speed is the ratio of the position difference between the first timing image frame 211 and the third timing image frame 213 to the time difference between the first time point and the third time point. In this preferred embodiment, side length of mask units 251 along a particular direction is directly proportional to the component of the object moving speed in that same particular direction. In other words, a faster speed an image object moves in one direction, a longer side length of mask unit 251 in that direction will result in a better mask effect.

In addition, for output image data sequence 200, third timing image frame 213 has an image frame refresh rate relative to the first timing image frame 211. Image frame refresh rate described herein is the displaying speed of image frames in the output image data sequence 200. In definition, image frame refresh rate is the inverse of refresh time of every image frame; in this embodiment it is the inverse of the time difference between the first time point and the third time point. Side length and area size of a mask unit 251 are directly proportional to the image frame refresh rate. In other words, side length and area size of a mask unit 251 are inversely proportional to the time difference between the first time point and the third time point.

In the preferred embodiment shown in FIG. 7*a*, mask frame 250 is generated based on the first timing image frame 211. In other words, image data processor 800 duplicates data of the first timing image frame 211 to be the base of mask frame 250. Data of the first timing image frame 211 described above includes data sequence of display information. Image data processor 800 runs an AND operation to set the stored value of a particular data address in the first timing image frame 211 as a first value which represents dark area. The data stored in the particular data address are display pixel parameters of a particular position on the display image, for example, color and brightness, etc. The first value representing dark area is preferably an electronic signal indicative of zero. In a preferred embodiment, when an eight-digit stored value stored at the particular data address and an eight-digit zero value run an AND operation together, the stored value generated from the AND operation is the eight-digit zero value. After the stored value is changed to the first value representing dark area, for example, zero, the particular position on the mask frame 250 will turn to be dark area when displayed on the display device 900, so as to form mask units 251. Other areas which haven't run an AND operation to form mask units 251 still retain data of first timing image frame 211, so as to form image units 253. Furthermore, changing the particular data address at which the image data processor 800 runs an AND operation can change the size and the shape of the mask units 251. Please note, besides the method of using an AND operation to form mask frame 250, in present invention, other types of operations or methods can be used, such as overlapping, to form mask units 251 and mask frame 250.

Figure 7B:
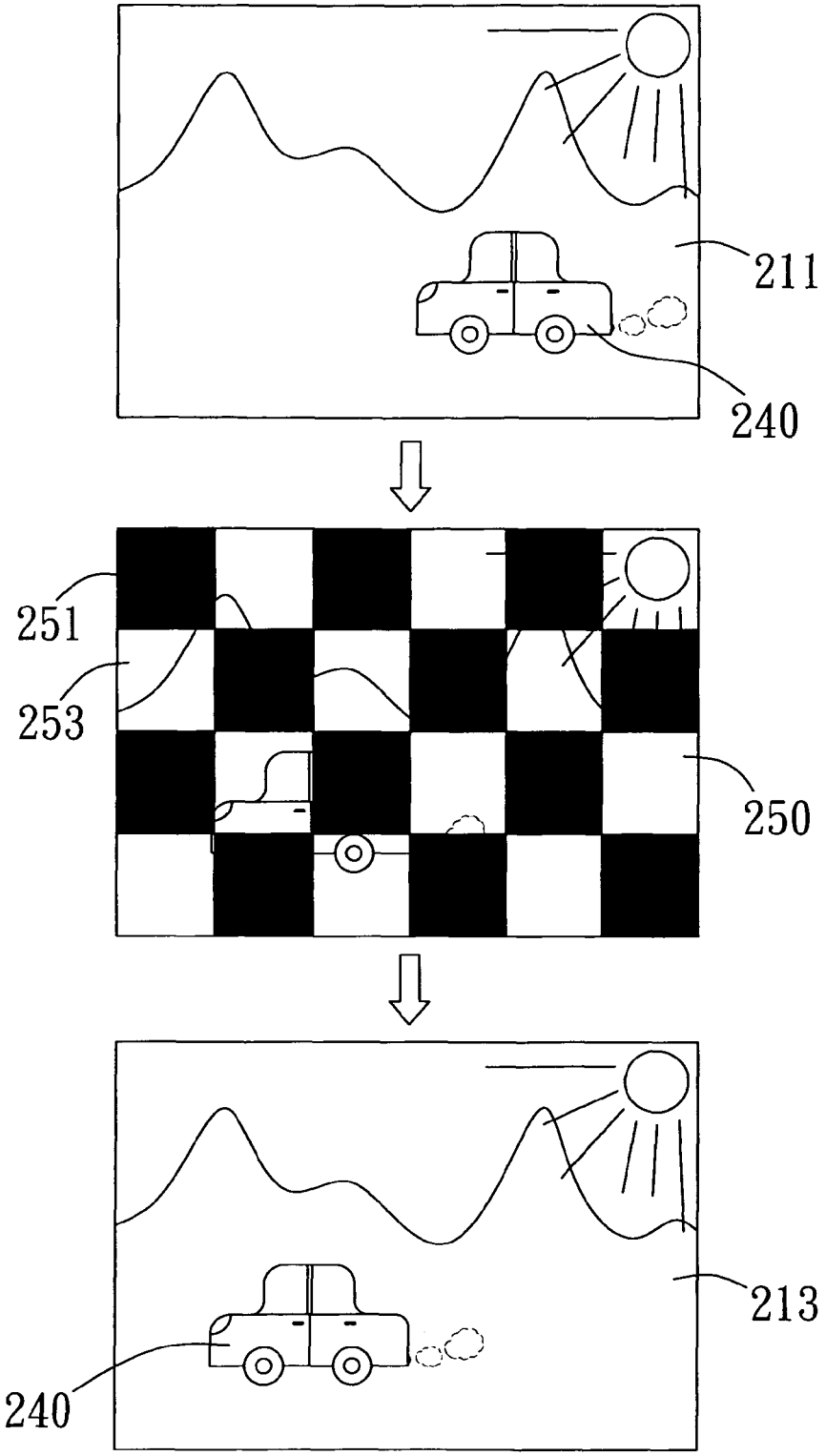
FIG. 7*b* is an illustration of one embodiment of duplicating third timing image frame to generate a mask frame.

FIG. 7*b* shows another embodiment of generating mask frame 250. In this embodiment, mask frame 250 is formed based on third timing image frame 213; in other words, image data processor 800 duplicates the data of third timing image frame 213 to be the base of mask frame 250. Method of forming other mask units 251 is the same as the method shown in FIG. 7*a*, except the image data processor 800 needs to read the data of third timing image frame 213 before forming mask frame 250.

Figure 8A:
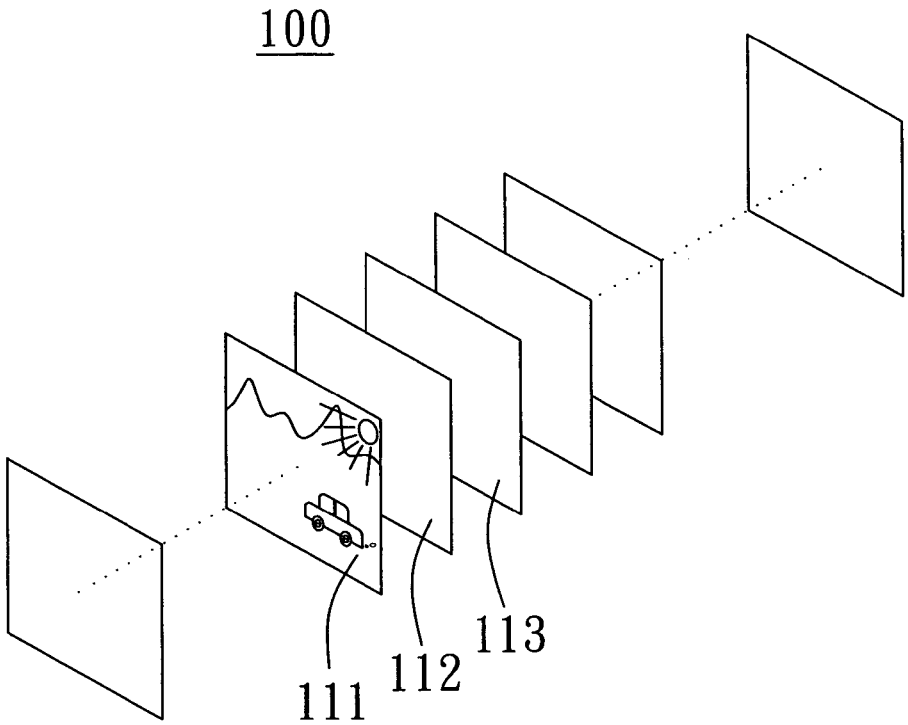
FIG. 8*a* is an illustration of another embodiment of initial image data.
Figure 8B:
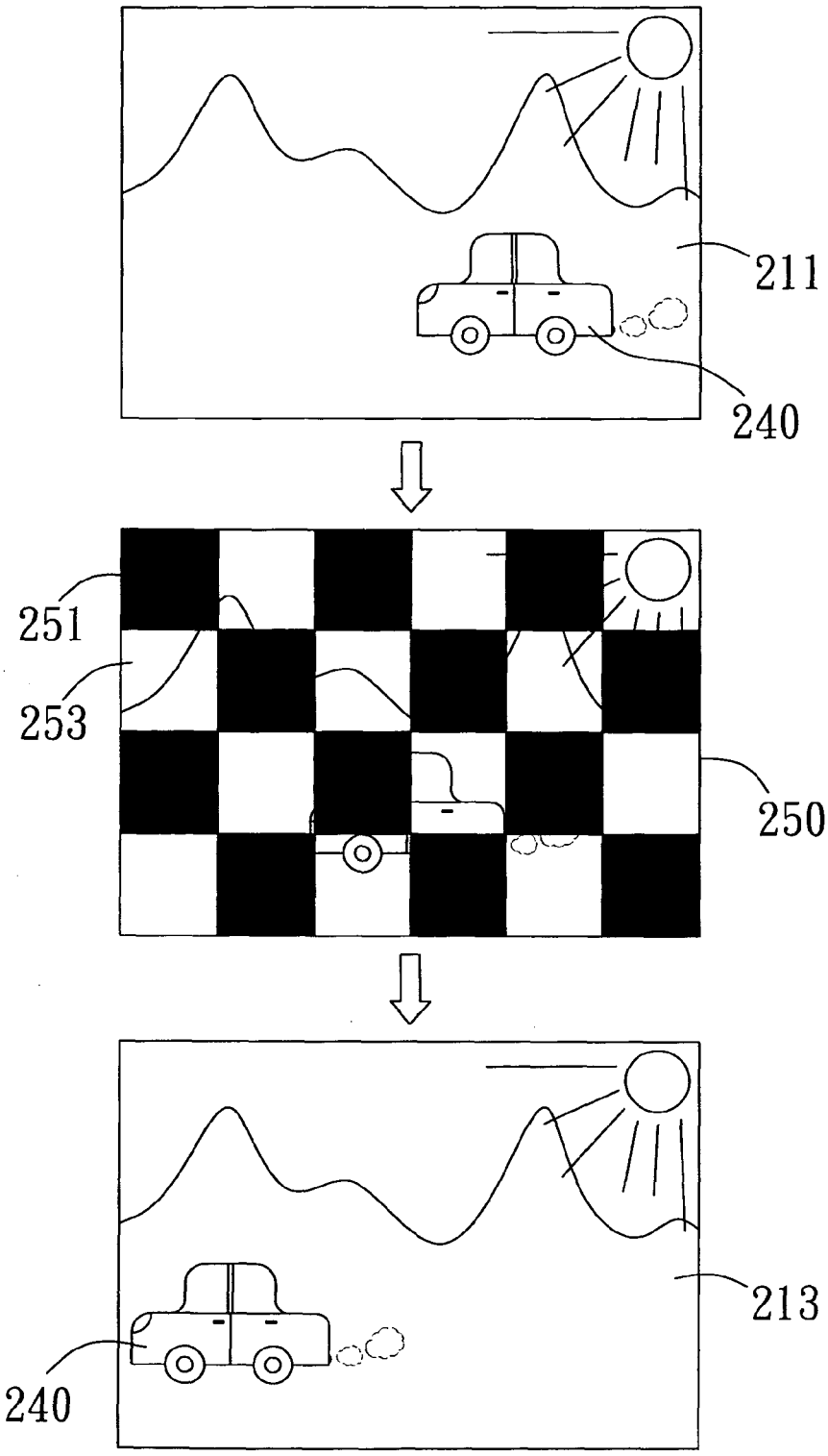
FIG. 8*b* is an illustration of one embodiment of duplicating second timing image frame to generate a mask frame.

FIG. 8*a* and FIG. 8*b* show another embodiment of present invention. In this embodiment, a second timing image frame 112 is sequenced between a first timing image frame 111 and a third timing image frame 113 in the initial image data 100. As the image data processor 800 transforms the initial image data 100 to be an output image data sequence 200, as shown in FIG. 8*b*, the second timing image frame 112 is transformed directly to be mask frame 250. In other words, image data processor 800 runs an AND operation directly on the second timing image frame 112, and changes the stored value of a particular data address in second timing image frame 112 to be a value indicative of dark area to form mask units 251.

Figure 9A:
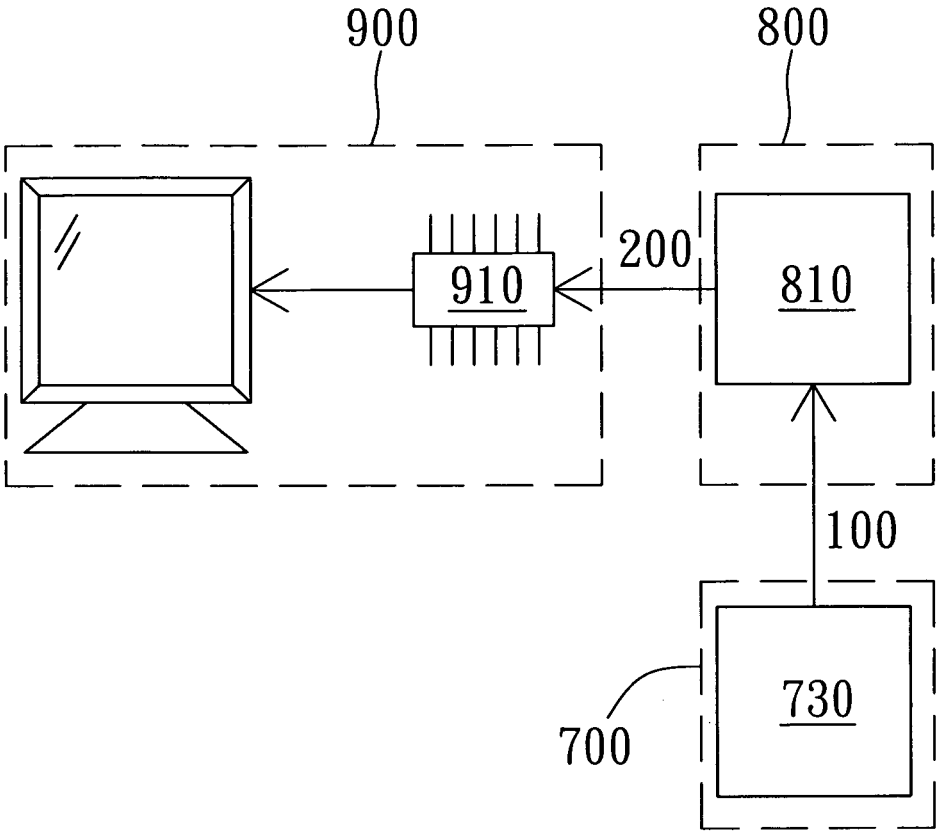
FIG. 9*a* is an illustration of one embodiment of image display device system.
Figure 9B:
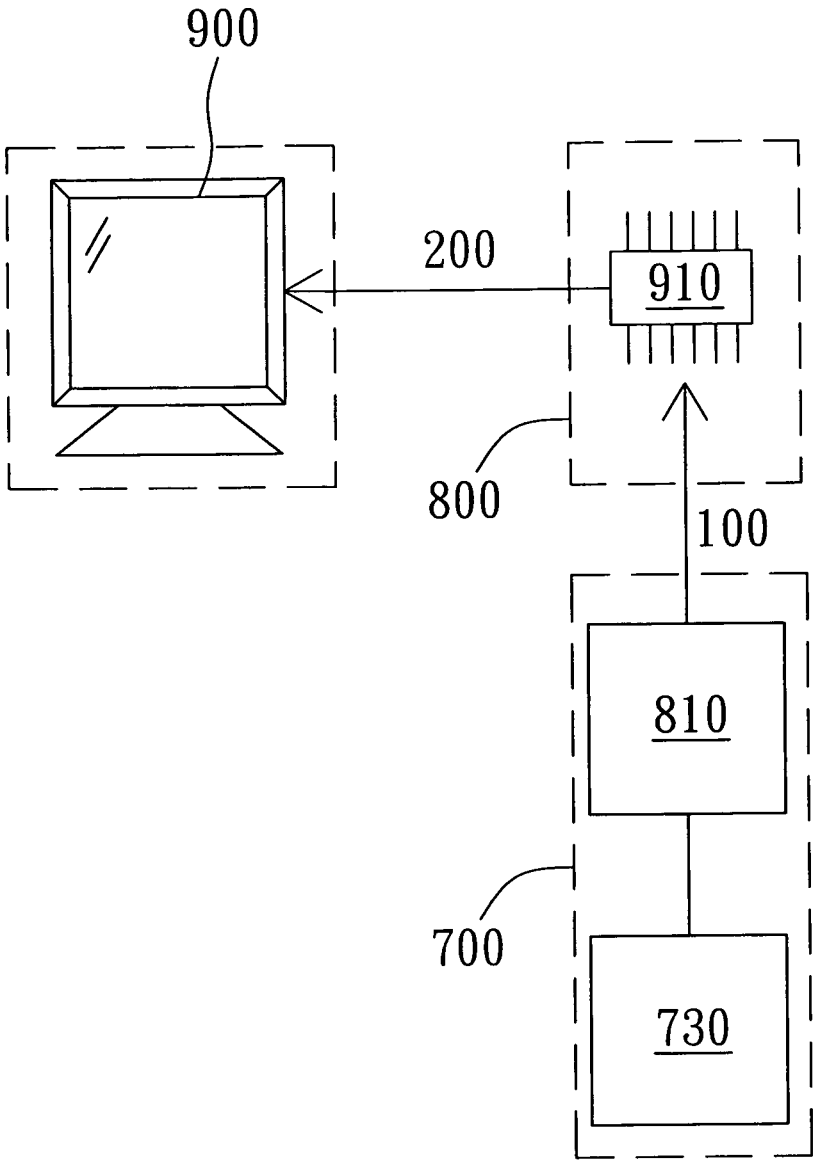
FIG. 9*b* is an illustration of another embodiment of image display device system.

In the case of system setup, as shown in FIG. 9*a*, image data processor 800 preferably includes an image graphic card 810, and image data input device 700 includes an input interface 730. At this time, operation used for forming mask frame 250 takes place in image graphic card 810, and is completed by the program loaded by the image graphic card 810. Then, the transformed output image data sequence 200 is transmitted to the display device processor 910 in the display device 900. However, in the embodiment shown in FIG. 9*b*, image data processor 800 includes display device processor 910; it means that operation used for forming mask frame 250 takes place in the display device processor 910 and is completed by the program loaded by the display device processor 910. At this time the image graphic card 810 is a part of the image data input device 700 for transmitting initial image data 100 to the display device processor 910. Display device processor 910 transmits the transformed output image data 200 to the display device 900 to display images.

Figure 10A:
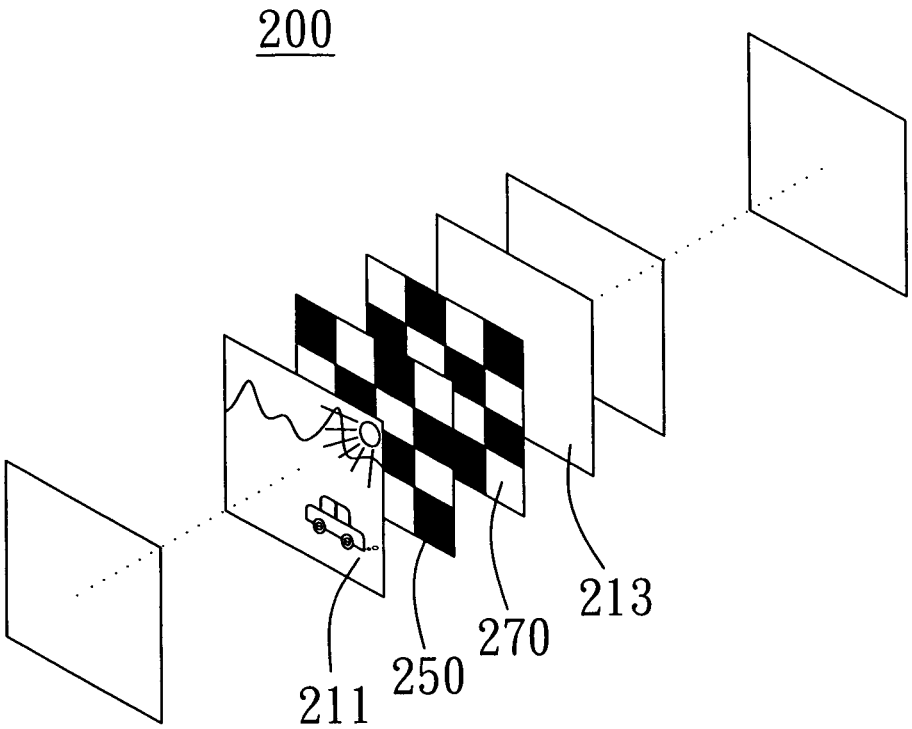
FIG. 10*a* illustrates another embodiment of image data sequence output.
Figure 10B:
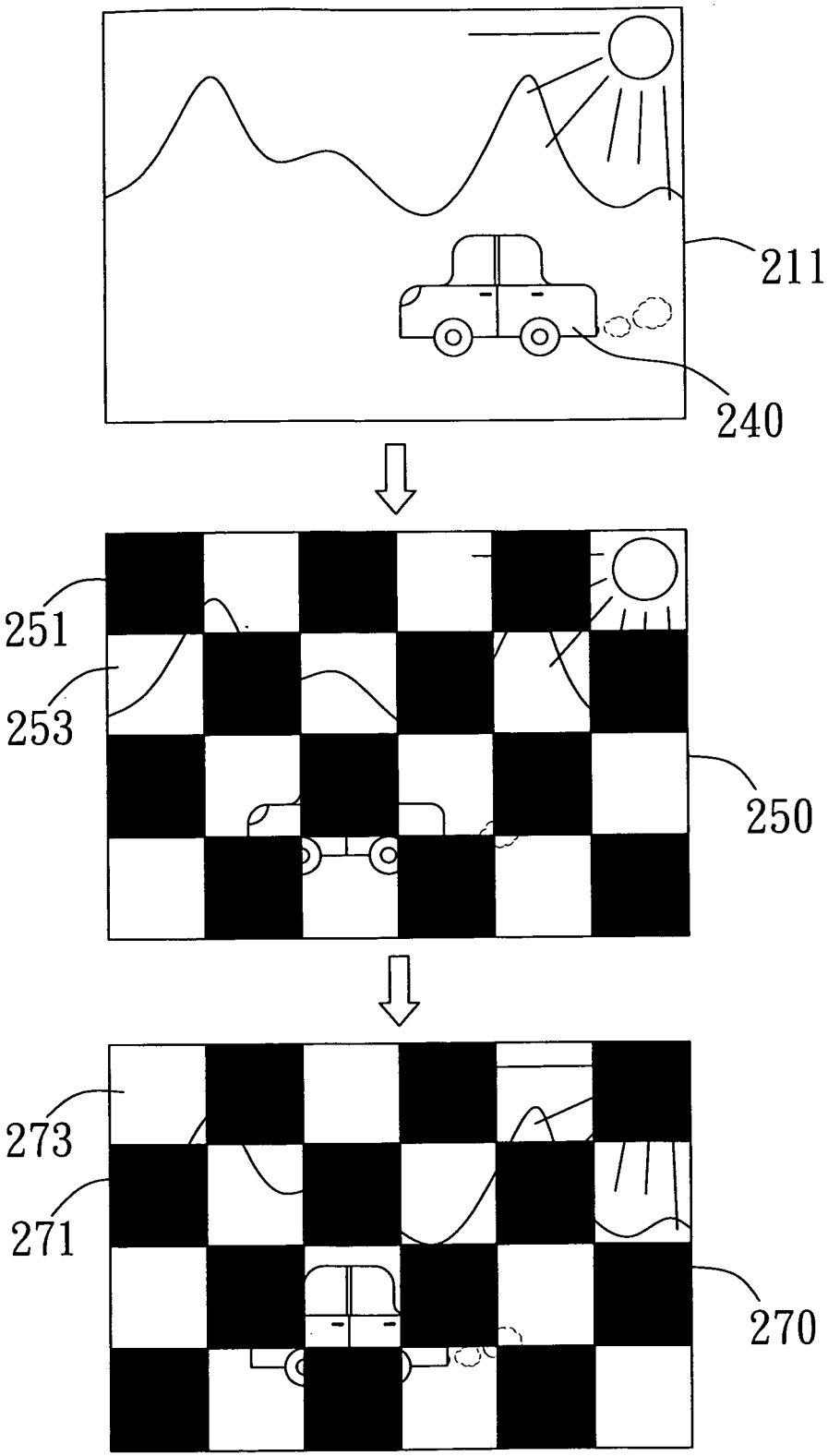
FIG. 10*b* illustrates one embodiment of complementary mask frame and mask frame.

FIG. 10*a* and FIG. 10*b* illustrate another embodiment of present invention. In this embodiment, output image data 200 further includes a complementary mask frame 270. As shown in FIG. 10*a*, complementary mask frame 270 is sequenced between the mask frame 250 and the third timing image frame 213. As shown in FIG. 10*b*, complementary mask frame 270 includes a plurality of complementary mask units 271 and a plurality of complementary image units 273. The positions of complementary mask units 271 on the complementary mask frame 270 are corresponding to the positions of image units 253 on the mask frame 250; the positions of complementary image units 273 on the complementary mask frame 270 are corresponding to the positions of mask units 253 on the mask frame 250. In other words, the portion formed to be mask units 251 on the mask frame 250 is the portion formed to be complementary image units 273 on the complementary mask frame 270. Because the images with certain degree of brightness are changed to dark area, the mask units 251 of the mask frame 250 will influence the brightness performance at its positions and the brightness as a whole. By placing complementary mask frame 270, the influences of the mask frame 250 on the brightness will reduce.

Moreover, method of forming complementary mask frame 270 is similar to the method of forming mask frame 250. In this embodiment, image data processor 800 duplicates first timing image frame 211 to be the base of complementary mask frame 270. However in other embodiments, image data processor 800 can duplicate third timing image frame 213 to be the base of complementary mask frame 270.

Figure 10C:
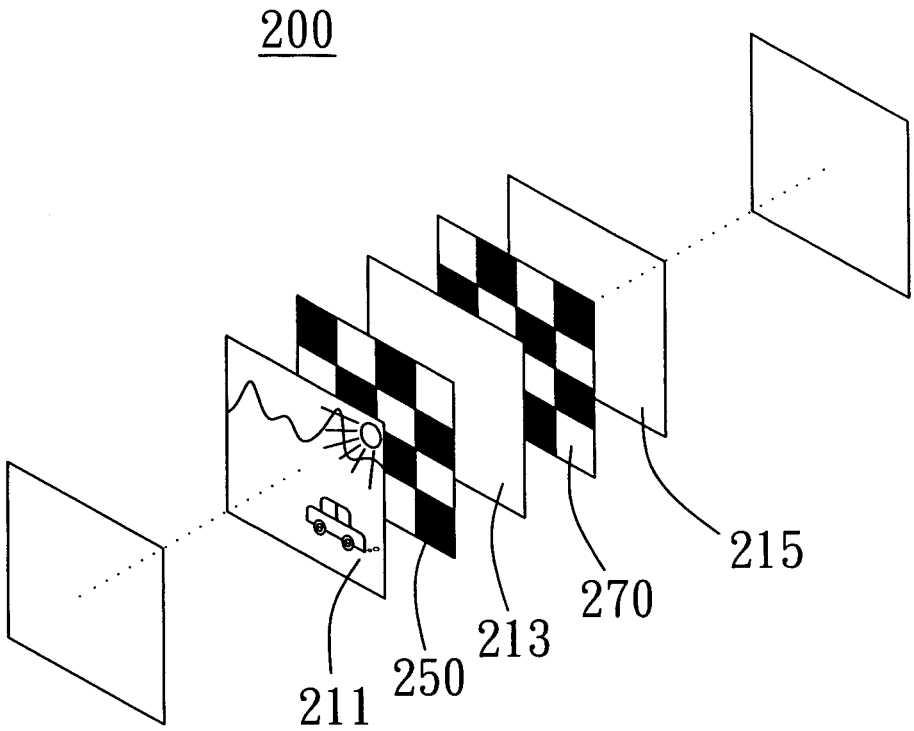
FIG. 10*c* illustrates another embodiment of image data sequence output.

In the embodiment shown in FIG. 10*c*, mask frame 250 is sequenced between first timing image frame 211 and third timing image frame 213; complementary mask frame 270 is sequenced after third timing image frame 213. In this embodiment, image data processor 800 preferably duplicates third timing image frame 213 to be the base of complementary mask frame 270; however in other embodiments, image data processor 800 can also duplicate fifth timing image frame 215, or duplicate fourth timing image frame 214 between the third timing image frame 213 and the fifth timing image frames 215, to be the base of complementary mask frame 270.

In a preferred embodiment, mask units 251 preferably spread evenly on the mask frame 250. However, in the embodiment shown in FIG. 11, mask units 251 can only spread on part of the mask frame 250 where foreground motion images locate. In this embodiment, before the image data processor 800 runs an AND operation to set the stored value of a particular data address in the first timing image frame 211, a comparison of the first timing image frame 211 data with the third timing image frame 213 data is done to decide where the foreground motion images locate. Location of the foreground motion images is regarded as a defined range of the particular data address to be set by running an AND operation. That means, only particular data address inside the range where the foreground motion images locate will be set by running an AND operation, in order to form mask units 251 on the mask frame 250. The main purpose of forming mask units 251 is to reduce vision persistence; therefore, the mask units 251 only generate mask effects on the images with motion. According to this method, the ratio of area size of the mask units 251 to the total area size of the mask frame 250 is reduced without influencing mask effect; as a result, performance of brightness as a whole is improved.

Figure 12:
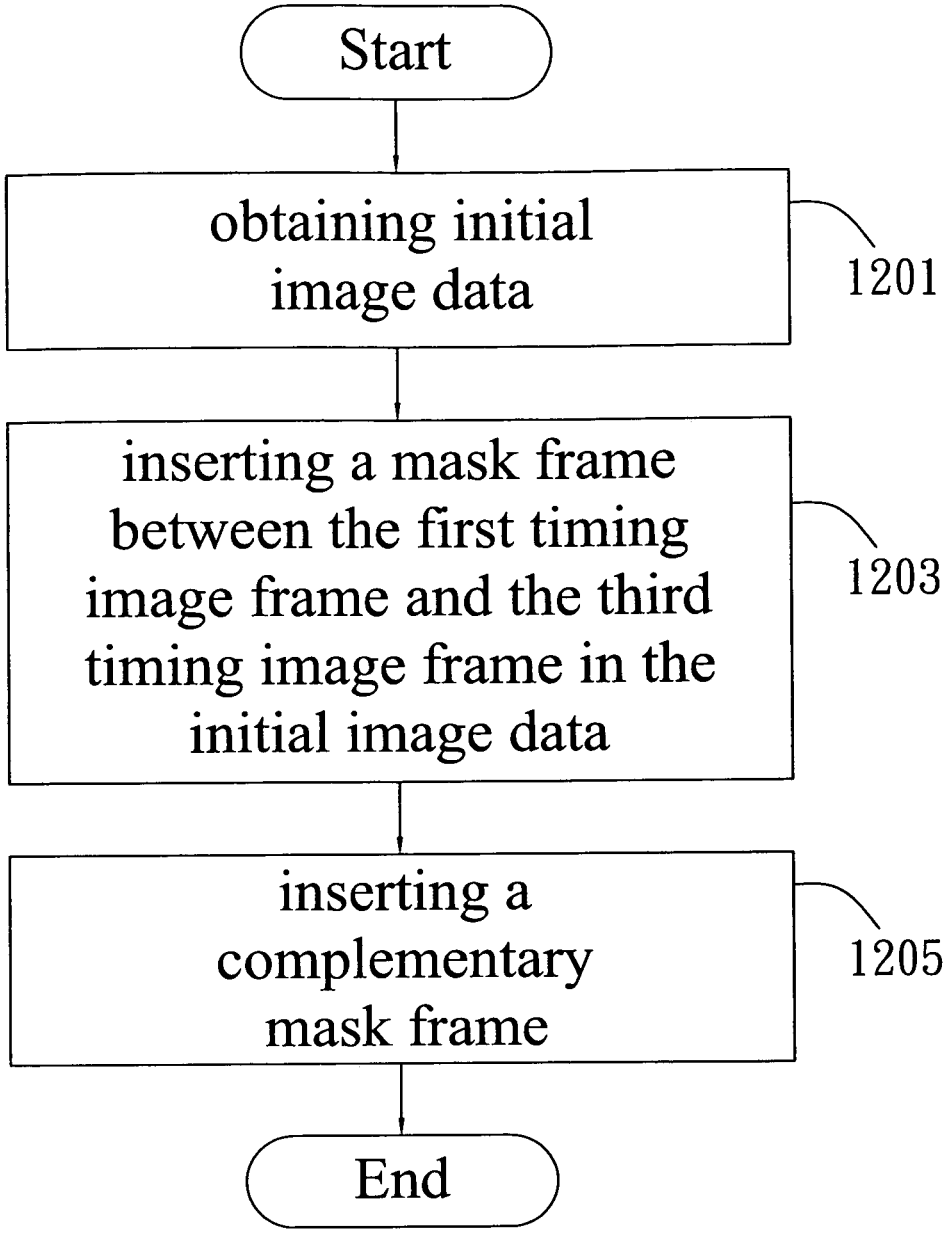
FIG. 12 is a flow chart of one embodiment of generating method of image data sequence in present invention.

FIG. 12 shows an embodiment of generating image data sequence in present invention. Method of generating image data sequence includes step 1201, obtaining initial image data, and step 1203, inserting a mask frame between the first timing image frame and the third timing image frame in the initial image data. As shown in FIG. 5*a*, mask frame 250 includes a plurality of mask units 251 and a plurality of image units 253 arranged in an array form. In other words, mask units 251 and display units 253 are arranged in two intersecting array directions X and Y. Mask units 251 and image units 253 arranged in different directions in the array results in a multi-directional mask effect for the mask frame 250, thereby reduces differences of mask effects in different directions. In addition, the way of arranging mask units 251 and image units 253 in array form can reduce impact of mask frame 250 on brightness of output images as a whole.

Figure 13:
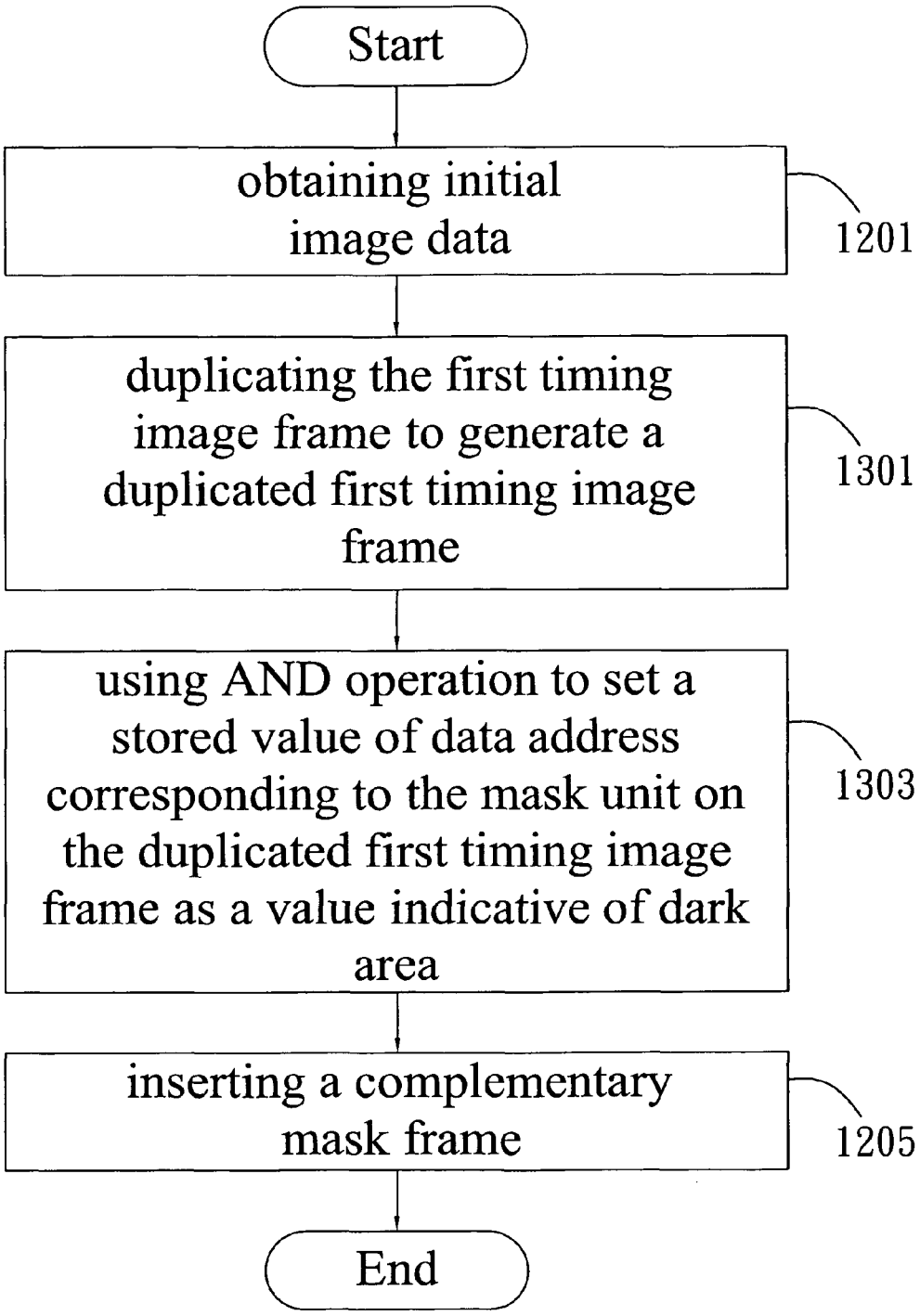
FIG. 13 is a flow chart of one embodiment of steps of inserting mask frame.

As shown in FIG. 13, mask frame forming step 1203 can further include step 1301: duplicating the first timing image frame in order to generate a duplicated first timing image frame. This duplicated first timing image frame is used as the base of the mask frame. However in different embodiments, in step 1301 the third timing image frame is duplicated instead to generate a duplicated third timing image frame as the base of the mask frame. Step 1303: includes using an AND operation to set a stored value of data address corresponding to the mask unit on the duplicated first timing image frame as a value indicative of dark area. Since the duplicated first timing image frame is duplicated from the first timing image frame, the stored value of data address corresponding to the mask unit on the duplicated first timing image frame includes image pixel parameters on the particular position of the original first timing image frame, such as color or brightness. For the stored value of data address, the first value indicative of dark area is preferably an electronic signal indicative of zero. In a preferred embodiment, when an eight-digit stored value stored at the particular data address and an eight-digit zero value together run an AND operation, the stored value generated from the AND operation is the eight-digit zero value. When the stored value is changed to be the first value representing dark area, for example, zero, the particular position on the mask frame 250 will turn to be dark area when displayed on the display device 900, so as to form mask units 251.

Figure 14:
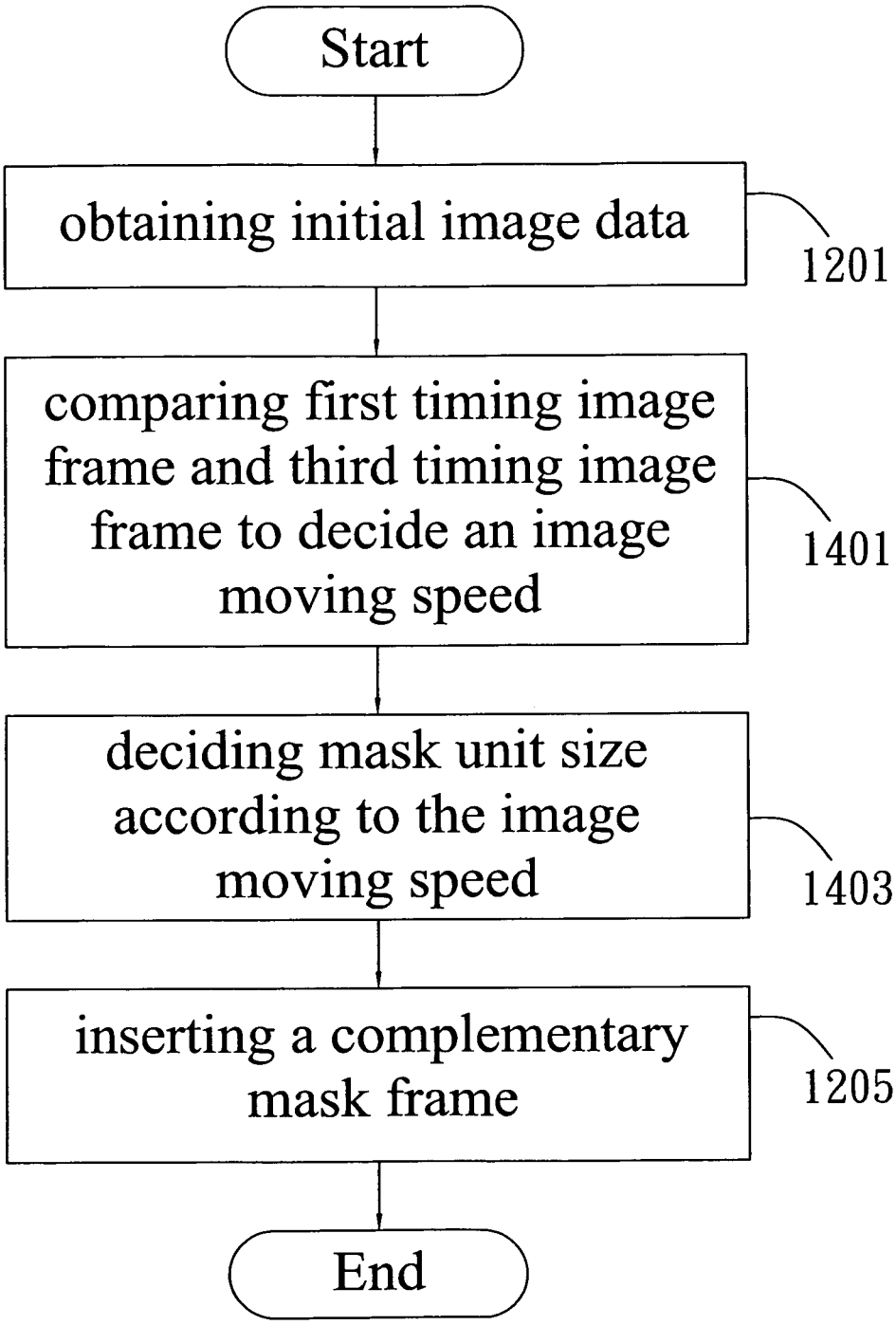
FIG. 14 is a flow chart of another embodiment of steps of inserting mask frame.

As shown in FIG. 14, mask frame forming step 1203 can further include step 1401: comparing first timing image frame and third timing image frame to decide an image moving speed. Since the third timing image frame appears after the first timing image frame, the image object on the third timing image frame has an image object speed relative to the image object on the first timing image frame. The image object described herein is preferably a foreground motion image object; however, in other embodiments, image object can include a background image object. This object moving speed is the ratio of the position difference between the first timing image frame and the third timing image frame where the same image object is on at different time points to the time difference between the first time point and the third time point.

In the following step 1402, mask unit size is decided according to the image moving speed. In this preferred embodiment, side length of mask units 251 along a particular direction is directly proportional to the component of the object moving speed in that same particular direction. In other words, faster an image object moves in one direction, a longer side length of mask unit 251 in that direction will result in a better mask effect. In addition, in other embodiments, besides image moving speed, mask unit size can be adjusted according to an image frame refresh rate provided by the system. The image frame refresh rate mentioned herein is an inverse of refresh time of every image frame. The image frame refresh rate for this embodiment is the inverse of the time difference between the first time point and the third time point.

Figure 11:
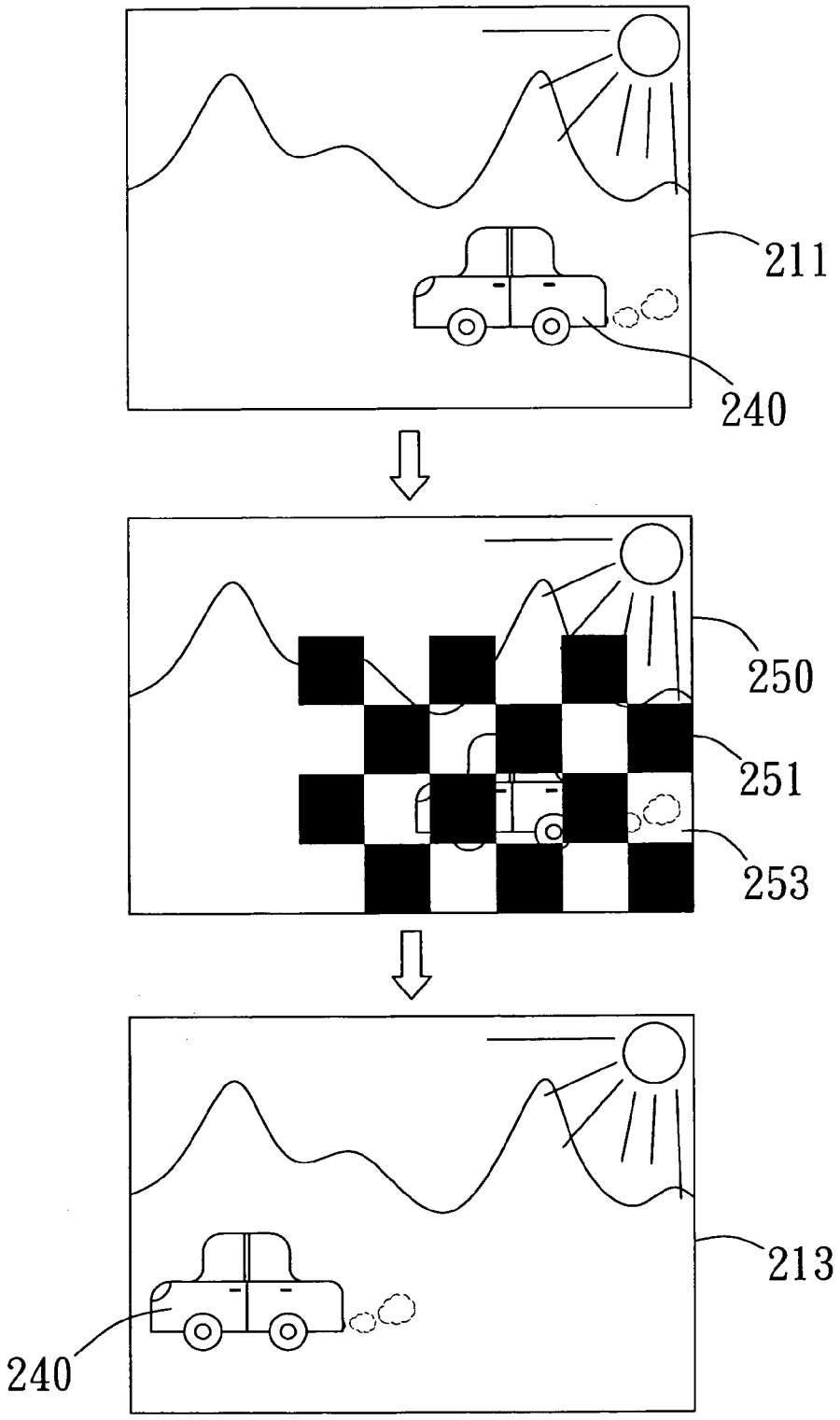
FIG. 11 is an illustration of another embodiment of mask frame.

Besides image moving speed, a foreground motion image position can be decided by comparing the first timing image frame and the third timing image frame. Mask units 251 on the mask frame 250 at this time can only locate on the positions corresponding to the positions of foreground motion images, as shown in FIG. 11. The main purpose of forming mask units 251 is to reduce vision persistence;

therefore, the mask units 251 only generate mask effects on the images with motion. According to this method, the ratio of area size of the mask units 251 to the total area size of the mask frame 250 is reduced without influencing mask effect; as a result, performance of brightness as a whole is improved.

As shown in FIG. 12, method of generating image data sequence in present invention further include step 1205: inserting a complementary mask frame. In the preferred embodiment shown in FIG. 10*a*, complementary mask frame 270 is sequenced between mask frame 250 and the third timing image frame 213. However, in the embodiment shown in FIG. 10*c*, complementary mask frame 270 can also sequenced after the third timing image frame 213. Complementary mask frame 270 includes a plurality of complementary mask units 271 and a plurality of complementary image units 273, of which positions are respectively opposite to those of the mask units and those of the image units on the mask frame 250. Therefore, a complementary effect on images is generated and influence of mask frame 250 to the brightness as a whole is balanced. However, the complementary mask frame is optionally set if needed, without compulsion.

Method of forming complementary mask frame is similar to that of forming mask frame. Generally speaking, either the first timing image frame or the third timing image frame is duplicated to be the base of complementary mask frame dependent on the position of complementary mask frame. For example, when the complementary mask frame is inserted between the mask frame and the third timing image frame, the duplicated first timing image frame is chose to be the base; when the complementary mask frame is sequenced after the third timing image frame, the duplicated third timing image frame is chosen otherwise. Then, stored value of a particular data address corresponding to the complementary mask frame on the duplicated first timing image frame or on the duplicated third timing image frame is set by using an AND operation, in order to set the image pixel parameter as a value indicative of dark area.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An image display device, comprising:

an image data input device, for inputting an initial image data including a plurality of image frames; and an image data processing device, transforming the initial image data to an output image data sequence, the output image data sequence comprising:

a first timing image frame;

a third timing image frame, sequenced after the first timing image frame; and a mask frame, sequenced between the first timing image frame and the third timing image frame, the mask frame including a plurality of mask units and a plurality of image units arranged in two intersecting array directions, wherein one image unit is placed between two mask units in the same array direction;

wherein each mask unit has a rectangular dark area, and each image unit has a rectangular image area, the third timing image frame has an image frame refresh rate, and a side length of the rectangular dark area is directly proportional to the image frame refresh rate.

2. The image display device of claim 1, wherein the image unit includes image data of a corresponding position of the image unit on the first timing image frame.

3. The image display device of claim 1, wherein the image unit includes image data of a corresponding position of the image unit on the third timing image frame.

4. The image display device of claim 1, wherein the image unit includes image data of a corresponding position of the image unit on a second timing image frame, wherein the second timing image frame is sequenced between the first timing image frame and the third timing image frame.

5. The image display device of claim 1, further comprising a complementary mask frame, sequenced between the mask frame and the third timing image frame, the complementary mask frame including a plurality of complementary mask units and a plurality of complementary image units, wherein positions of the complementary mask units are corresponding to the positions of the image units on the mask frame, and the positions of the complementary image units are corresponding to the positions of the mask units on the mask frame.

6. The image display device of claim 1, further comprising a complementary mask frame, the third timing image frame sequenced between the mask frame and the complementary mask frame, the complementary mask frame including a plurality of complementary mask units and a plurality of complementary image units, wherein the positions of the complementary mask units are corresponding to the positions of the image units on the mask frame, and the positions of the complementary image units are corresponding to the positions of the mask units on the mask frame.

7. The image display device of claim 1, wherein the plurality of mask units only spread on part of the mask frame where a foreground motion image is located.

8. An image display device, comprising:

an image data input device, for inputting an initial image data including a plurality of image frames; and an image data processing device, transforming the initial image data to an output image data sequence, the output image data sequence comprising:

a first timing image frame, being one of the plurality of image frames at a first timing in the initial image data;

a third timing image frame, being one of the plurality of image frames at a third timing in the initial image data, sequenced after the first timing image frame; and a mask frame, sequenced between the first timing image frame and the third timing image frame, the mask frame including a plurality of mask units and a plurality of image units arranged in two intersecting array directions, wherein one image unit is placed between two mask units in the same array direction, the plurality of image units correspond to one of the first timing image frame and the third timing image frame, the image unit includes image data of a corresponding position of the image unit on the one of the first timing image frame and the third timing image frame;

wherein the mask unit has a rectangular dark area, the image unit has a rectangular image area, the third timing image frame includes an image object having an object moving speed relative to the first timing image frame, and a side length of the rectangular dark area is directly proportional to the object moving speed.

9. The image display device of claim 8, further comprising a complementary mask frame, sequenced between the mask frame and the third timing image frame, the complementary mask frame comprising a plurality of complementary mask units and a plurality of complementary image units, wherein the positions of the complementary mask units are corresponding to the positions of the image units on the mask frame, and the positions of the complementary image units are corresponding to the positions of the mask units on the mask frame.

10. The image display device of claim 9, wherein the complementary image unit has an image data of a corresponding position of the complementary image unit on the first timing image frame.

11. The image display device of claim 8, further comprising a complementary mask frame, the third timing image frame sequenced between the mask frame and the complementary mask frame, the complementary mask frame comprising a plurality of complementary mask units and a plurality of complementary image units, wherein the positions of the complementary mask units are corresponding to the positions of the image units on the mask frame, and the positions of the complementary image units are corresponding to the positions of the mask units on the mask frame.

12. The image display device of claim 11, wherein the complementary image unit has an image data of a corresponding position of the complementary image unit on the first timing image frame.

13. The image display device of claim 8, wherein the plurality of mask units only spread on part of the mask frame where a foreground motion image is located.

14. An image display device, comprising:

an image data input device, for inputting an initial image data including a plurality of image frames; and an image data processing device, transforming the initial image data to an output image data sequence, the output image data sequence comprising:

a first timing image frame, being one of the plurality of image frames at a first timing in the initial image data;

a third timing image frame, being one of the plurality of image frames at a third timing in the initial image data, sequenced after the first timing image frame; and a mask frame, sequenced between the first timing image frame and the third timing image frame, the mask frame including a plurality of mask units and a plurality of image units arranged in two intersecting array directions, wherein one image unit is placed between two mask units in the same array direction and the image unit includes image data of a corresponding position of the image unit on a second timing image frame, wherein the second timing image frame is one of the plurality of image frames at a second timing in the initial image data and sequenced between the first timing image frame and the third timing image frame;

wherein the mask unit has a rectangular dark area, the image unit has a rectangular image area, the third timing image frame includes an image object having an object moving speed relative to the first timing image frame, and a side length of the rectangular dark area is directly proportional to the object moving speed.

15. The image display device of claim 14, further comprising a complementary mask frame, sequenced between the mask frame and the third timing image frame, the complementary mask frame comprising a plurality of complementary mask units and a plurality of complementary image units, wherein the positions of the complementary mask units are corresponding to the positions of the image units on the mask frame, and the positions of the complementary image units are corresponding to the positions of the mask units on the mask frame.

16. The image display device of claim 15, wherein the complementary image unit has an image data of a corresponding position of the complementary image unit on the first timing image frame.

17. The image display device of claim 14, wherein the plurality of mask units only spread on part of the mask frame where a foreground motion image is located.

18. The image display device of claim 14, further comprising a complementary mask frame, the third timing image frame sequenced between the mask frame and the complementary mask frame, the complementary mask frame including a plurality of complementary mask units and a plurality of complementary image units, wherein the positions of the complementary mask units are corresponding to the positions of the image units on the mask frame, and the positions of the complementary image units are corresponding to the positions of the mask units on the mask frame.

19. The image display device of claim 18, wherein the complementary image unit has an image data of a corresponding position of the complementary image unit on the first timing image frame.

20. An image display device, comprising:

an image data input device, for inputting an initial image data including a plurality of image frames; and an image data processing device, transforming the initial image data to an output image data sequence, the output image data sequence comprising:

a first timing image frame, being one of the plurality of image frames at a first timing in the initial image data;

a third timing image frame, being one of the plurality of image frames at a third timing in the initial image data and having an image object having an object moving speed relative to the first timing image frame, sequenced after the first timing image frame; and a mask frame, sequenced between the first timing image frame and the third timing image frame, the mask frame including a plurality of mask units and a plurality of image units arranged in two intersecting array directions, wherein one image unit is placed between two mask units in the same array direction, the plurality of image units correspond to one of the first timing image frame, the second timing image frame, and the third timing image frame, the image unit includes image data of a corresponding position of the image unit on the one of the first timing image frame, the second timing image frame, and the third timing image frame, and the plurality of mask units only spread on part of the mask frame where a foreground motion image is located.

21. The image display device of claim 20, further comprising a complementary mask frame, sequenced between the mask frame and the third timing image frame, the complementary mask frame comprising a plurality of complementary mask units and a plurality of complementary image units, wherein the positions of the complementary mask units are corresponding to the positions of the image units on the mask frame, and the positions of the complementary image units are corresponding to the positions of the mask units on the mask frame.

22. The image display device of claim 21, wherein the complementary image unit has an image data of a corresponding position of the complementary image unit on the first timing image frame.

23. The image display device of claim 20, wherein the mask unit has a rectangular dark area, the image unit has a rectangular image area, the third timing image frame includes an image object having an object moving speed relative to the first timing image frame, and a side length of the rectangular dark area is directly proportional to the object moving speed.

24. The image display device of claim 20, wherein the mask unit has a rectangular dark area, the image unit has a rectangular image area, the third timing image frame has an image refresh rate, and a side length of the rectangular dark area is directly proportional to the image refresh rate.

25. The image display device of claim 20, further comprising a complementary mask frame, the third timing image frame sequenced between the mask frame and the complementary mask frame, the complementary mask frame including a plurality of complementary mask units and a plurality of complementary image units, wherein the positions of the complementary mask units are corresponding to the positions of the image units on the mask frame, and the positions of the complementary image units are corresponding to the positions of the mask units on the mask frame.

* * * * *